US009726466B2

(12) United States Patent
Naud et al.

(10) Patent No.: US 9,726,466 B2
(45) Date of Patent: Aug. 8, 2017

(54) FUEL/AIR CONCUSSION APPARATUS

(71) Applicant: DMD Systems LLC, Los Alamos, NM (US)

(72) Inventors: Darren Naud, Los Alamos, NM (US); John David Thomas, Huntsville, AL (US)

(73) Assignee: DMD Systems, LLC, Los Alamos, NM (US)

( * ) Notice: Subject to any disclaimer, the term of this patent is extended or adjusted under 35 U.S.C. 154(b) by 0 days.

(21) Appl. No.: 14/621,982

(22) Filed: Feb. 13, 2015

(65) Prior Publication Data

US 2016/0238360 A1 Aug. 18, 2016

(51) Int. Cl.

| | |
|---|---|
| ***F42B 12/42*** | (2006.01) |
| ***F42B 12/48*** | (2006.01) |
| ***F42B 4/16*** | (2006.01) |
| *F42B 4/00* | (2006.01) |

(52) U.S. Cl.

CPC ..... *F42B 12/42* (2013.01); *F42B 4/16* (2013.01); *F42B 12/48* (2013.01)

(58) Field of Classification Search

CPC .. F42B 12/42; F42B 12/36; F42B 8/26; F42B 12/52; F42B 5/15; F42B 5/145; F42B 12/48; F42B 12/46; F42B 4/16

USPC ..... 102/335, 363, 334, 355, 360, 367, 370, 102/283, 293

See application file for complete search history.

(56) References Cited

U.S. PATENT DOCUMENTS

| | | | | | |
|---|---|---|---|---|---|
| 2,372,264 | A * | 3/1945 | Firth | F42B 12/52 | 102/365 |
| 3,194,161 | A * | 7/1965 | Becker | F42B 8/26 | 102/498 |
| 4,074,628 | A * | 2/1978 | Manning | F42B 12/52 | 102/363 |
| 4,466,330 | A * | 8/1984 | Juretzek | C08K 3/08 | 102/529 |
| 4,947,753 | A * | 8/1990 | Nixon, III | F42B 8/26 | 102/269 |
| 5,076,171 | A * | 12/1991 | Altenau | F42B 12/62 | 102/334 |
| 5,235,915 | A * | 8/1993 | Stevens | C06B 33/00 | 102/439 |
| 6,214,139 | B1 * | 4/2001 | Hiskey | C06B 43/00 | 149/109.2 |
| 6,298,784 | B1 * | 10/2001 | Knowlton | C06B 45/00 | 102/205 |
| 6,412,416 | B1 * | 7/2002 | Rouse | F42B 5/15 | 102/334 |
| 6,470,806 | B1 * | 10/2002 | Murray | F42B 3/16 | 102/370 |
| 6,523,478 | B1 * | 2/2003 | Gonzalez | F42B 30/04 | 102/216 |

(Continued)

*Primary Examiner* — Michelle R Clement
*Assistant Examiner* — Bridget Cochran
(74) *Attorney, Agent, or Firm* — James C. Kennedy, III, Esq.

(57) ABSTRACT

A concussion device for creating a low level of smoke and a selectively tuned low-toned sound, the device including a structure having a cavity, the cavity having a top opening; a first energetic charge disposed in a bottom portion of the cavity; and a member removably secured to the structure within the cavity and partially overlying the first energetic charge.

20 Claims, 5 Drawing Sheets

(56) References Cited

U.S. PATENT DOCUMENTS 7,220,328 B1 * 5/2007 Koppes ..... A01N 43/90 149/46
8,025,011 B1 * 9/2011 Yafai ..... F42B 12/36 102/487
8,136,437 B2 * 3/2012 Van Stratum ..... F42B 27/08 102/368
8,161,883 B1 * 4/2012 Harasts ..... F41A 33/04 102/361
8,365,668 B2 * 2/2013 Brunn ..... F42B 27/00 102/364
8,402,893 B2 * 3/2013 Van Rooijen ..... F42B 4/22 102/335
8,677,904 B2 * 3/2014 Rexford ..... F42B 5/145 102/342
8,857,341 B1 * 10/2014 Andrews ..... F42C 14/02 102/486
8,904,940 B1 * 12/2014 Pann ..... F42B 27/00 102/368
8,967,046 B2 * 3/2015 Dunaway ..... 102/202
9,046,334 B1 * 6/2015 Redding ..... F42C 19/095
9,194,669 B2 * 11/2015 Widener ..... F42B 4/26
9,217,624 B2 * 12/2015 Naud ..... F42B 4/06
9,261,339 B2 * 2/2016 Mancini ..... F42B 12/42
2001/0007229 A1 * 7/2001 Dales ..... F42B 7/02 102/506
2002/0152912 A1 * 10/2002 Hiskey ..... C06C 15/00 102/289
2004/0011235 A1 * 1/2004 Callaway ..... F41J 2/02 102/336
2004/0112242 A1 * 6/2004 Brunn ..... F42B 7/10 102/498
2004/0159259 A1 * 8/2004 Walker ..... F41F 1/06 102/335
2007/0068414 A1 * 3/2007 O'Dwyer ..... F41A 19/62 102/374
2008/0223246 A1 * 9/2008 Dindl ..... F42B 10/48 102/502
2008/0280264 A1 * 11/2008 Segall ..... G09B 9/003 434/11
2010/0186615 A1 * 7/2010 Kodama ..... B60R 21/2644 102/530
2010/0212533 A1 * 8/2010 Brunn ..... F42B 4/26 102/502
2010/0275802 A1 * 11/2010 Green ..... C06B 23/004 102/335
2010/0282109 A1 * 11/2010 Caldwell ..... F42B 4/16 102/367
2011/0017090 A1 * 1/2011 Menefee, III ..... F42B 7/02 102/448
2011/0079164 A1 * 4/2011 Broden ..... F42B 8/14 102/444
2011/0168305 A1 * 7/2011 Blau ..... C06B 33/04 149/14
2011/0311948 A1 * 12/2011 Lu ..... F42B 8/26 434/11
2012/0012021 A1 * 1/2012 Dryer ..... F42B 15/10 102/381
2012/0020050 A1 * 1/2012 Longo ..... F42B 12/40 362/34
2012/0208134 A1 * 8/2012 Blau ..... C06B 33/04 431/8
2013/0104766 A1 * 5/2013 Thomas ..... F42B 12/36 102/487
2013/0255523 A1 * 10/2013 Naud ..... F42B 4/06 102/357
2013/0319278 A1 * 12/2013 Kravel ..... F42B 12/48 102/334
2013/0333815 A1 * 12/2013 Blau ..... C06B 31/02 149/22
2014/0130695 A1 * 5/2014 Chong ..... F42B 8/26 102/334
2014/0305328 A1 * 10/2014 Dierks ..... F42B 12/40 102/363
2015/0233686 A1 * 8/2015 Naud ..... F42B 4/26 102/335
2015/0285602 A1 * 10/2015 Mancini ..... F42B 12/42 102/360

* cited by examiner

FUEL/AIR CONCUSSION APPARATUS

FIELD

The disclosure generally relates to concussion apparatus. More particularly, the disclosure relates to a Fuel/air concussion apparatus that advantageously produces a low level of smoke and that produces an improved louder, low-toned sound. The pyrotechnic device is particularly suitable for entertainment purposes in indoor environments.

BACKGROUND

Concussion devices have been used for a variety of purposes including for entertainment where loud booms are produced with or without a corresponding flash of light and also as a weapon, such as flashbang device, which operates to produce both a flash and a bang with the intent to temporarily stun and blind a person.

In the entertainment industry, concussion devices may be used indoors and typically produce large amounts of smoke which may have undesired health effects as well as interfering with a desired visual environment.

There is therefore a need for a concussion device with reduced amounts of smoke as well as with improved auditory and/or visual effects It is an object of the invention to provide an improved concussion device with reduced amounts of smoke as well as with improved auditory and/or visual effects

SUMMARY

The disclosure is generally directed to a low smoke producing concussion device that has improved sound effects including a loud, concussive, with for example, a low-frequency toned sound, the performance of which may be particularly desirable for stadium-sized events.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary", "Example", or "illustrative" means "serving as an example, instance, or illustration." Any embodiment or implementation described herein as "exemplary" or "illustrative" is not necessarily to be construed as preferred or advantageous over other implementations. All of the implementations or embodiments described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1A:
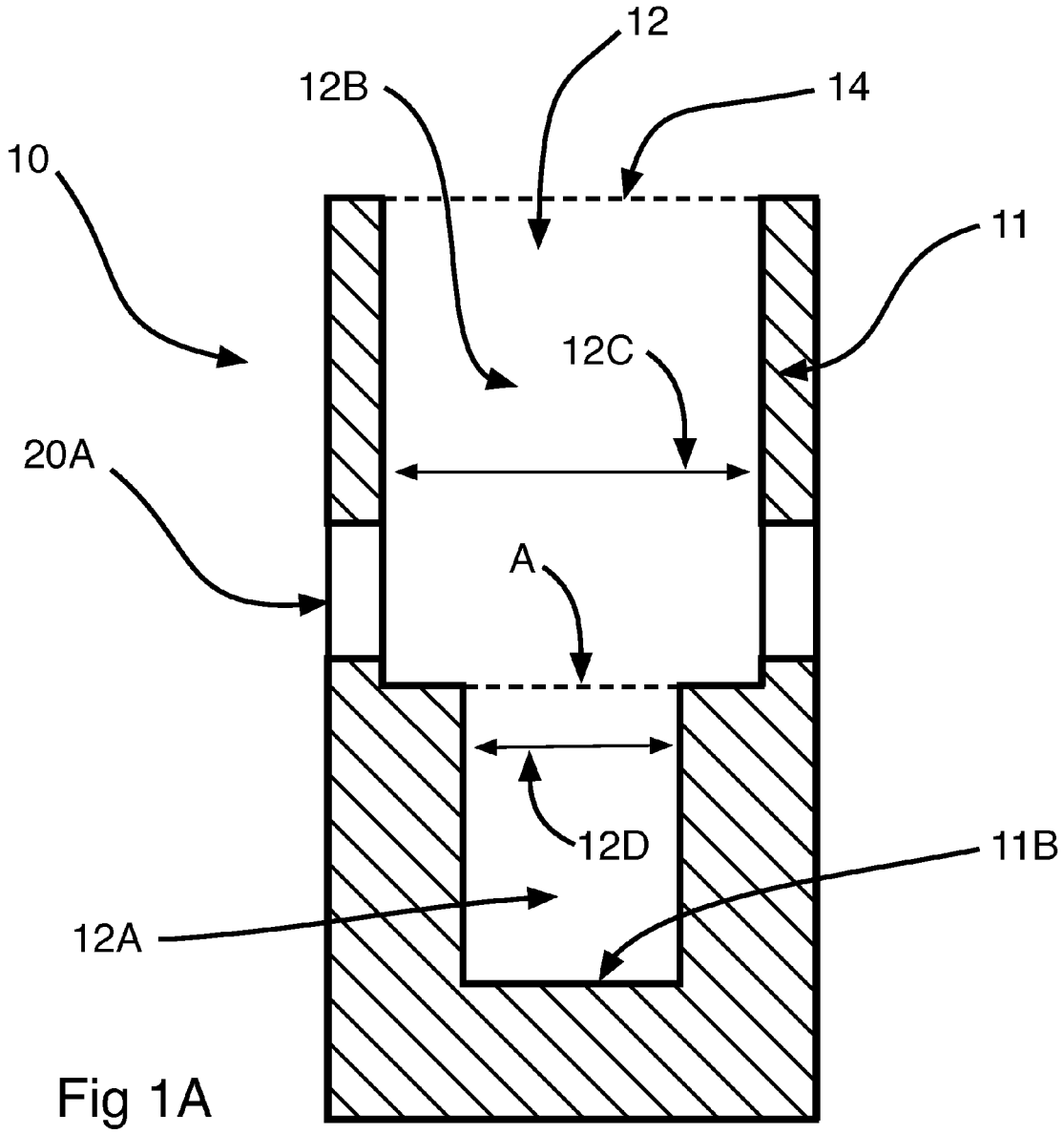
FIG. 1A is a cross-sectional schematic representation of an illustrative embodiment of a concussion device.
Figure 1B:
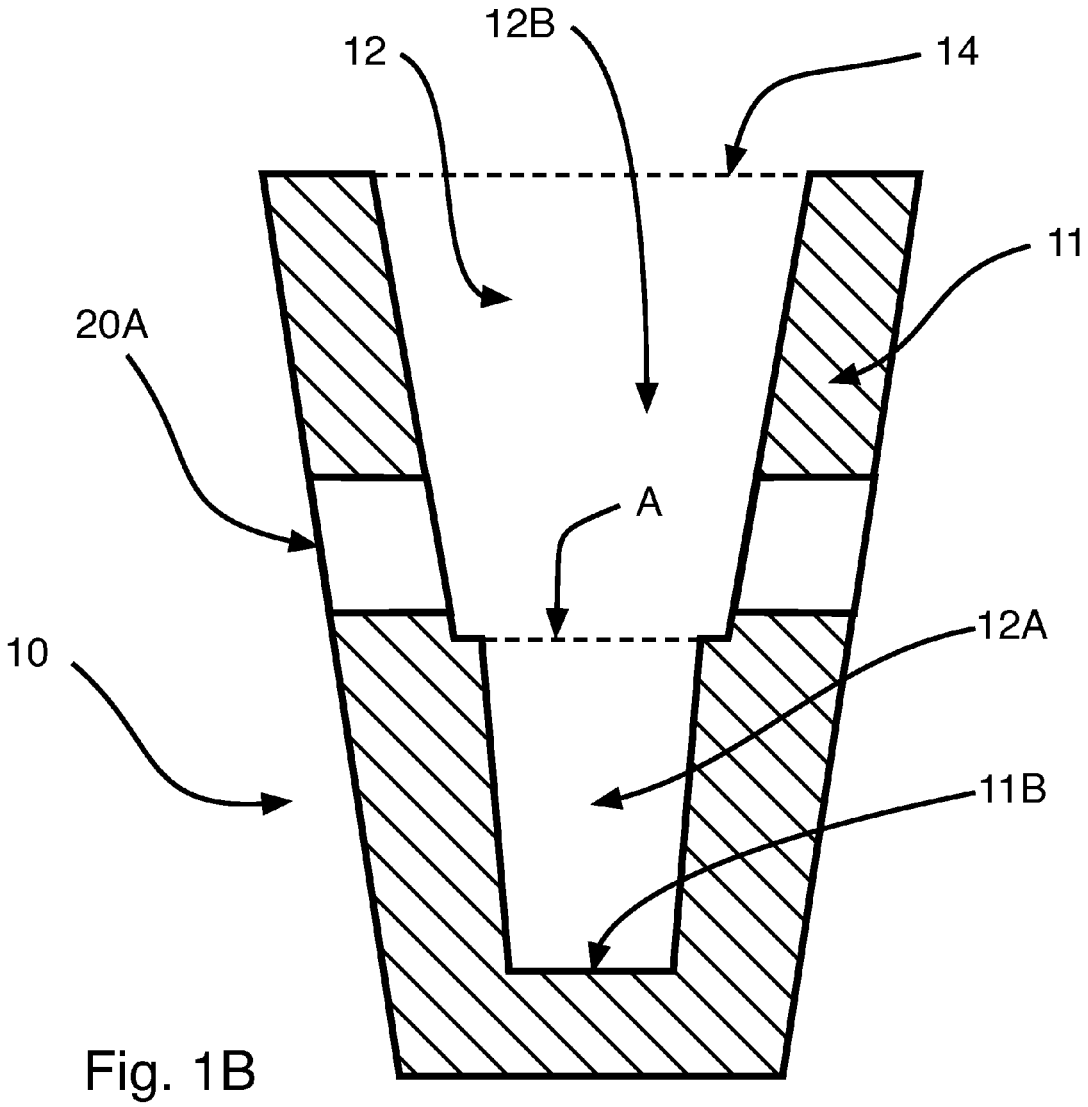
FIG. 1B is a cross-sectional schematic representation of another illustrative embodiment of a concussion device.

In one embodiment, referring to FIG. 1A, a concussion device 10 is shown that includes a cavity area 12 surrounded on all sides except for a top area 14 which is open. For example, an outer structure (mortar) having one or more walls 11 may enclose and define an inner cavity 12 including a bottom portion 11B and one or more walls 11 which enclose the cavity area 12 on all sides except for a top opening 14. While the shape of the device and the inner cavity may be any shape, typical preferred shapes of the device may include the cavity 12 being defined by the walls 11 in one or more sections having varying dimensions including a rectangular, conical, or circular shape or a combination thereof. For example, FIG. 1B shows a cross sectional representation of a conical shaped concussion device 10 having conical shaped cavity 12 sections e.g., lower section (breech) 12A and upper section (chimney) 12B.

The outer structure (mortar) and walls 11 may be made of any material having a structural strength sufficient to withstand detonation of an energetic material charge contained in the device such as structurally suitable materials including glass, plastic, metal, ceramic, or combinations thereof.

In an embodiment, the cavity 12 may include one or more sections of relatively different sized volumes. For example, as shown in FIG. 1A, the cavity 12 may include at least one upper section (chimney) e.g., 12B having a relatively larger volume, for example including a larger width dimension e.g., 12C compared to a width dimension, e.g., 12D of at least one lower section (breech) e.g., 12A.

In an embodiment, the at least one upper and lower cavity sections 12B and 12A may each have the same or different shape such as a rectangular, circular, or conical, or combination thereof. For example, as shown in FIG. 1A, the respective upper and lower cavity sections, 12B and 12A, each have a rectangular cross sectional shape. In an embodiment, a ratio of the upper 12B to lower 12A cavity section volumes may have a range of about 1:1 to about 10:1. Additionally, in other embodiments the relative width dimensions of the upper cavity 12B width e.g., 12C to lower cavity 12A width e.g., 12D may have a range of about 1:1 to about 5:1. In some embodiments, the entire volume of the cavity 12 (including upper and lower sections) may be from about 4 to about 50 cubic inches. In an embodiment the lower 12A cavity section (breech) may be defined by a relatively thicker wall 11 compared to the upper cavity section 12B. The one or more walls 11 may have a discontinuity in the inner portion of the one or more walls 11 defining the transition from the lower section 12A to the upper section 12B, e.g., thicker walls 11 defining lower section 12A.

Figure 1C:
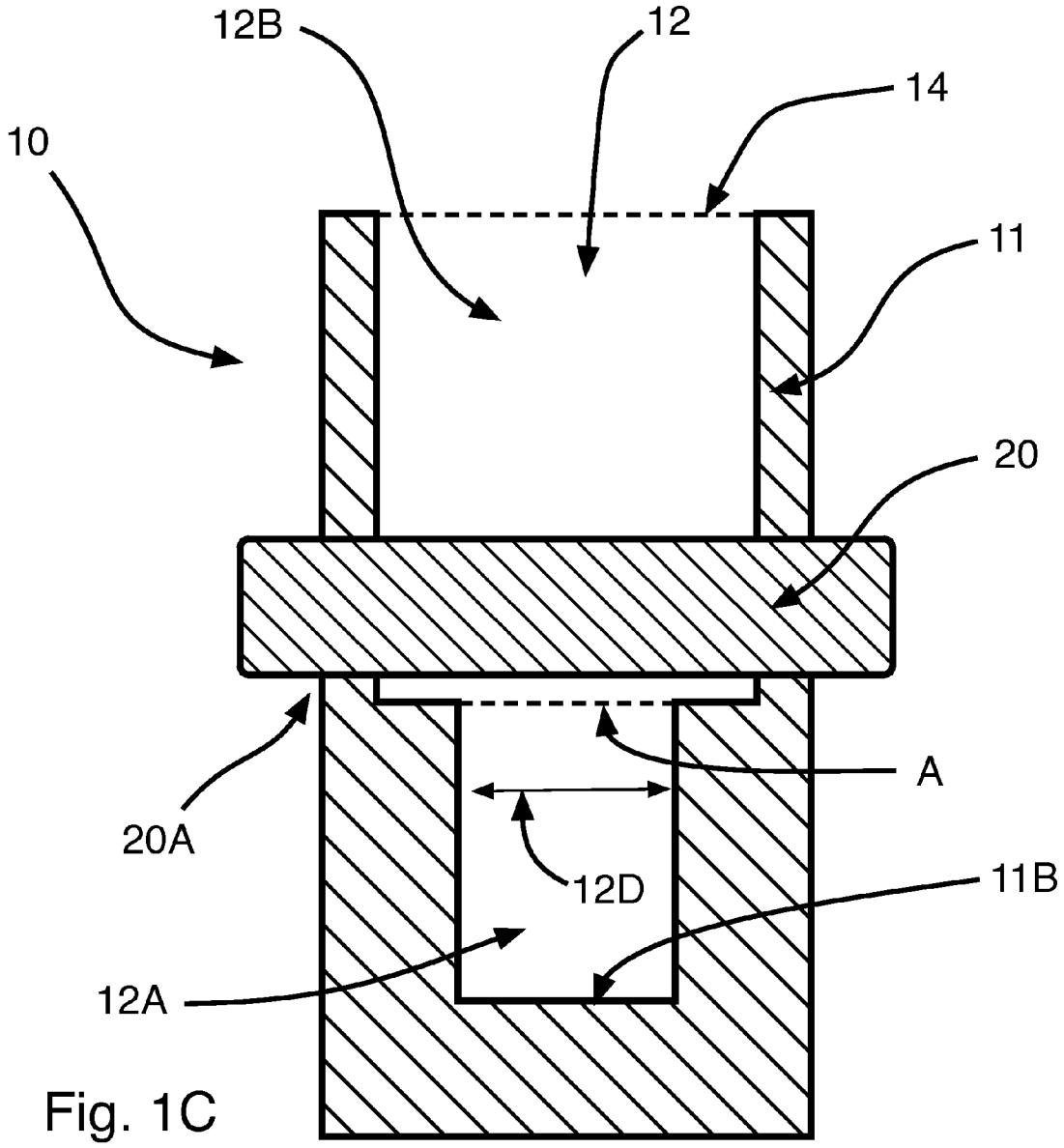
FIG. 1C is a cross-sectional schematic representation of another illustrative embodiment of a concussion device.
Figure 2:
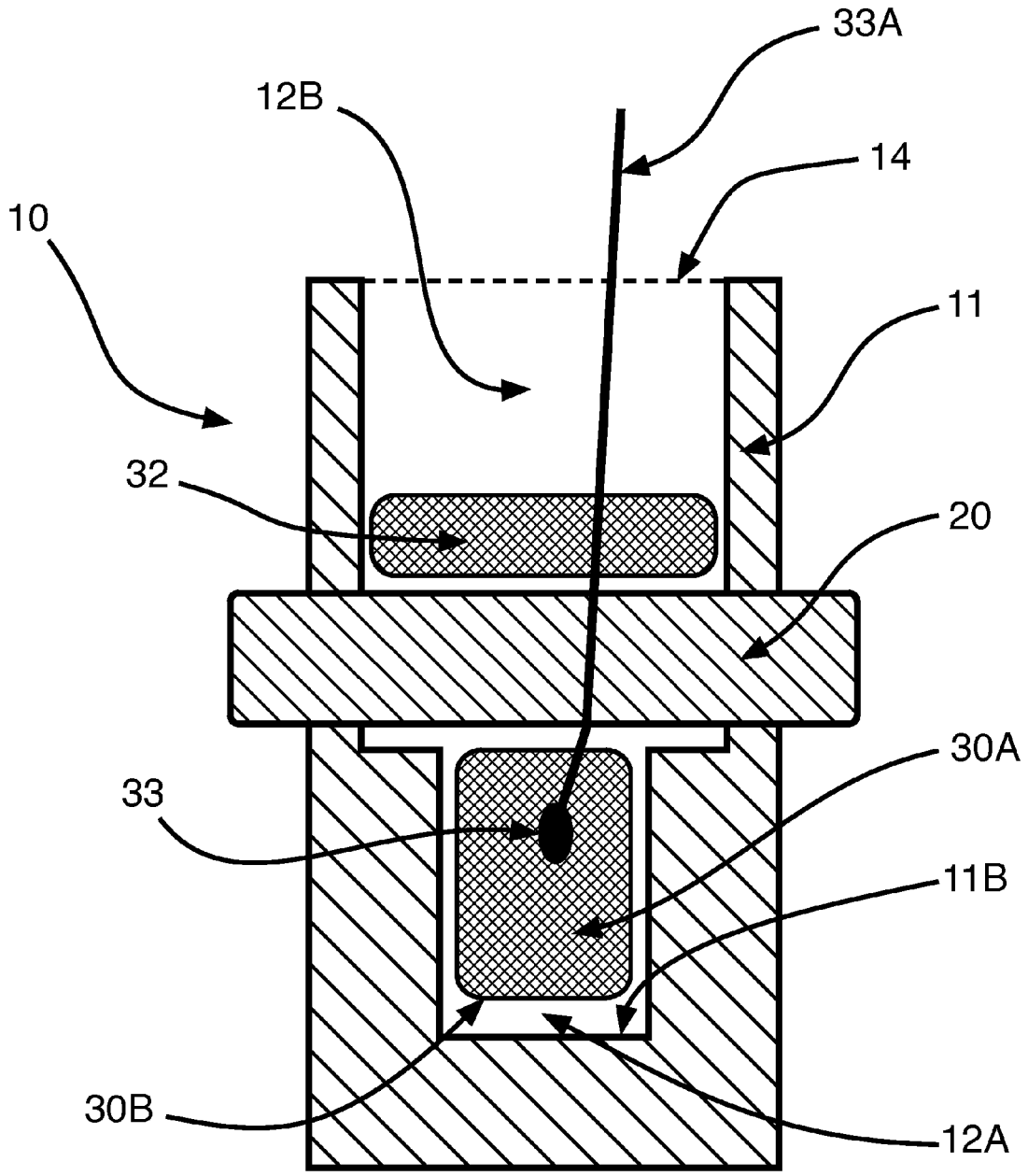
FIG. 2 is a cross-sectional schematic representation of another illustrative embodiment of a concussion device with associated energetic material.

In an embodiment, referring to FIG. 1C, one or more members e.g., member 20 may at least partially overlie and partially cover an area "A" defined by the uppermost portion of the lower cavity section 12A (breech). The member 20 is preferably securely placed to overly and partially cover the area "A". i.e., sufficient to withstand a concussive detonation of an energetic charge, placed within the breech 12A, as shown in FIG. 2. By concussive detonation is meant an explosive detonation creating a shock wave. In an embodiment the one or more members e.g., 20 may be elongated such as in a rod or bar shape (shock bar) having a rectangular or circular shape or combination thereof. In an embodiment, the one or more members 20 extend across at least a portion of the upper cavity section 12B above the lower cavity section 12A (breech) to cover at least a portion of the area "A" overlying the uppermost section of the lower cavity section 12A.

Still referring to FIG. 1C, in one embodiment the one or more elongated members 20 may be fitted within openings or slots e.g., 20A in the one or more walls 11 to be securely held and fully extend across the diameter of the upper cavity section (chimney) 12B above the breech 12A. The one or more elongated members 20 may comprise varying widths and may cover a portion of the area "A" of the lower cavity section 12A from about 0 to about 95 percent of the area "A". In some embodiments the one or more shock bars 20 may have a width of about 0.4 inches to about 2.0 inches.

In an embodiment, the one or more elongated members 20 (shock bar) may be made of any material having a structural strength sufficient to withstand concussive detonation of charges contained within the concussion device 10 including materials such as glass, plastic, metal, ceramic, or combinations thereof.

It will be appreciated that other methods of securely and removably holding the member 20 may be used, such that the member 20 may be easily removed prior to and following detonation but is securely held in place to withstand concussive detonation. For example, slots or depressions disposed in the inner portion of walls 11 may be used to securely hold the elongated member 20 in place during concussive detonation of the concussion device 10.

For example, it has been unexpectedly found that the removal of the member bar 20 advantageously provides a means to make concussive detonation of the concussion device less likely i.e., will provide a much less energetic or no detonation.

In another embodiment, still referring to FIG. 2 one or more combustible ignition charges comprising energetic material e.g., 30A may be disposed in the breech 12A of the cavity. The one or more ignition charges 30A may have at least one ignition source such as an electric match e.g., 33 embedded in at least one of the ignition charges e.g., 30A. In one embodiment, electrical leads e.g., 33A may extend therefrom to be accessible external to the concussion device (mortar) 10. It will be appreciated that other methods of detonation of the ignition charge may be used depending on the ignition charge material including a different electrical charge source within the breech 12A or another detonating charge placed contacting the one or more ignition charges 30A within the breech 12A.

In some embodiments, the one or more ignition charges 30A may include finely divided powder or fiber and may be loose or pressed into pellets. In some embodiments, the powder may have a grain (including agglomerate) size corresponding to about 100 to about 325 mesh. In an embodiment the one or more ignition charges 30A may be enclosed in a thin film of material e.g., 30B. For example, the thin film may be from about 0.0003 inches to about 0.003 inches thick. The thin film of material may be made out of materials such cellulose, metals, plastic, and combinations thereof.

In one embodiment, the one or more ignition charges 30A may include nitrocellulose in a range of about 20 to about 100 weight percent based on the total weight of the charge composition. In preferred embodiments, the amount of nitrocellulose in the ignition charge composition is in the range of 80-100 wt. % (weight percent). Such amounts of nitrocellulose result in a low smoke producing detonation of the concussion device.

In some embodiments other ingredients may be present such as other fuels and/or oxidizers (which may also function as a colorant). In a preferred embodiment, the one or more ignition charges are made of low smoke producing compositions as are known in the art for example, having a composition that includes 20 to about 100 weight percent nitrocellulose, more preferably greater than about 80 percent nitrocellulose based on a total weight of the charge composition. In some embodiments, elements such as transition and rare earth element containing materials, e.g., containing elements such as Mg, Sr, Ti, and the like may be present in relatively low amounts for visual effects e.g., less than about 10 wt. %. In addition, visual effect producing materials (e.g., including color, spark, flash, or combinations thereof) (e.g., colorants) may be included such as chlorine containing materials and metal colorants as are known in the pyrotechnic art including e.g., Sr(NO*, $SrCO_3$, Parlon, Aluminum Perchlorate (AP) and the like.

For example, colorants and/or oxidizers as are known in the art may include one or more of ammonium and/or metal nitrates, perchlorates, phosphates, carbonates, aminotetrazoles, arsenites, oxalates, oxychlorides, peroxides, oxides, sulphates, fluorides, and metal powders.

In some embodiments the colorants and/or oxidizers may be present in an amount of from about 1 to about 50 wt. %, more preferably, in an amount less than about 10 wt. %, for example from about 0.5 to about 10 wt. % with respect to the total weight of the charge composition.

In some embodiments the charge composition may include one more fuels as are known in the art including metal fuels such as magnesium, aluminum, silicon, calcium, iron, titanium, zinc, and their alloys, and including non-metal fuels such as charcoal, sulfur, boron, hexamine, nitroguanidine, dextrin, red gum, benzoic acid, and cellulose. The amount of fuels in the composition may be from 0-80 wt. % based on the total weight of the charge composition. In other embodiments mixtures of fuels and oxidizers as are known in the art in the same amounts such as black powder may be used.

In another embodiment, still referring to FIG. 2, following placement of the one or more ignition charges 30A, the one or more elongated members 20 may be then securely placed to at least partially extend across the upper cavity section 12B above the one or more ignition charges 30A and breech 12A. For example, by the term "securely" is meant to substantially remain in place during concussive detonation of the one or more ignition charges 30A.

In one embodiment, one or more second charges 32 comprising energetic material may be placed in the upper cavity section (chimney) 12B, above the one or more members 20 (e.g. shock bar). In one embodiment, the one or more energetic (second) charges 32 may at least partially fill the volume of the upper cavity section 12B above the member 20. For example, the one or more energetic charges 32 may at least partially fill the volume of the upper cavity section 12B at a level of about 0 to about 80 percent of the volume of the upper cavity section 12B.

In another embodiment, the one or more second charges 32 may include a low smoke producing composition the same or different from the first charges 30A. For example, the one or more energetic (second) charge may include nitrocellulose in the amount of about 20 to about 100 wt. %, more preferably from about 50 to about 100 wt. %. For example, a typical ignition or energetic charge 32 may be from between about 1 and 50 grams of nitrocellulose powder and include other ingredients discussed above in amounts of from about 0 to about 80 weight percent. In one embodiment, the one or more energetic charges 32 may include loose powder, fiber and/or pressed pellets of material and may be at least partially contained within a thin film of material similar to the ignition charge 30A. It will be appreciated that the one or more energetic (second) charges 32 may be the same or different in composition than the one or more ignition charges 30A. For example, in an embodiment, the one or more energetic charges 32 may include a relatively greater amount of visual effect producing materials (colorants and/oxidizers) compared to the one or more ignition charges 30A.

In one embodiment, the one or more second charges 32 may not have a separate ignition source, since the ignition of the one or more first charges 30A provides the ignition source for the one or more second charges 32.

Figure 3:
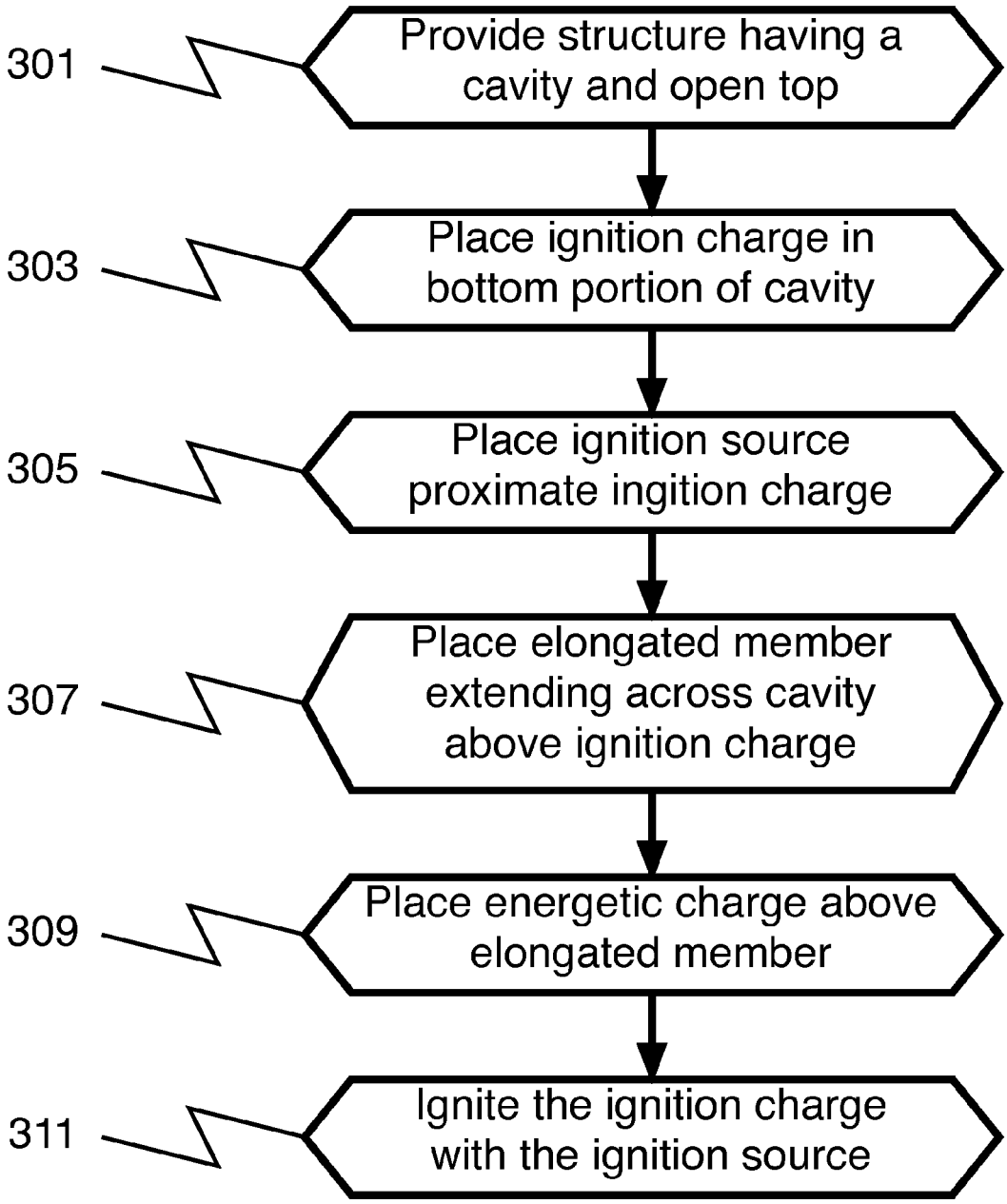
FIG. 3 is a flow diagram of still another alternative illustrative embodiment of preparing and detonating a concussion device.

Referring to FIG. 3, in another embodiment, in a method of preparing and detonating the concussion device 10 for use, in Step 301, a concussion device 10 with at least one inner cavity and at least one top opened portion associated with each cavity is provided. In step 303, one or more first ignition (energetic) charges e.g., 30A are placed in a lower portion (breech) of the at least one cavity e.g. within a breech, 12A. In step 305, one or more ignition sources is placed in or proximate the one or more ignition charges. In step 307, one or more members e.g., elongated members 20 are then securely placed to overlie at least a portion of the breech such as extending across the cavity dimension above the one or more ignition charges. In step 309, one or more energetic charges, e.g., 32 are placed above the one or more elongated members 20. In step 311 the one or more ignition charges 30A are ignited by the one or more ignition sources and the one or more ignition charges then ignite the one or more energetic charges 32.

While not intending to be bound by any theory of operation, it is believed that the one or more shock bars 20, serves several purposes including to partially confine the one or more first charges 30A (breech charge) inside the breech. In addition, when the breech charge explodes to produce heat and gas, the hot gases are diverted past the one or more shock bars 20 including into a V-shaped or other dispersed pattern. The dispersed pattern of gases may escape at shock speed, for example, at the speed of sound at standard temperature and pressure conditions.

In operation, upon ignition of an electric match or other ignition source, the breech charge 30A detonates and sends its gases into the chimney portion of the upper cavity section 12B above the shock bar 20. The gases may be diverted in a V-shaped or other shaped pattern that may be travelling at shock speeds to produce separate shock fronts (not shown). Since the shocked gases may have been split into at least two parts by the one or more shock bars 20, the gases may bounce back and forth inside the chimney portion of the concussion device 10.

During operation, the at least two shock fronts may cross over each other at extreme temperatures and pressures. The one or more second charges e.g. 32 in the chimney portion (e.g., upper cavity section 12B) may be impacted by the shocked gases and react to produce additional reactive gas products. The entire hot gas charge may be ejected through the top of the opening 14 of the concussion device 10 and mix with additional oxygen in the air external to the cavity section 12B. The gas mixtures may then continue to react in an explosive manner, producing a fuel/air explosion over a much larger volume of space compared to the open space within the cavity section 12B.

In some embodiments, the explosion produces a loud, concussive, low-frequency toned sound, which may be particularly desirable for stadium-sized events. It will be appreciated that visual effects, such as colors, sparks, flashes or combination thereof may be included in the pyrotechnic explosion if desired by addition of particular visual producing ingredients as discussed above. In addition, it will further be appreciated that the loudness, tone, pitch and other sound qualities may be altered by changing one or more of the shape, dimensions and/or number of the cavity, the shock bar and the amount of charges placed above and/or below the shock bar.

Example A

A fuel/air explosion concussion test was performed using a steel mortar having a 3" diameter and 6" height. Ten (10) grams of loosely packed nitrocellulose fibers sealed in a PVC (poly-vinyl chloride) bag was inserted into the mortar breech (12A) having a volume of about 3.4 cubic inches. Embedded inside the charge bag was an electric match. A 1⅜ diameter steel shock bar (20) was positioned just above the breech via two opposite holes in the mortar wall. A top charge of fiteen (15) grams of pressed nitrocellulose pellets, and packaged in a PVC bag was placed inside the chimney (12B) just above the shock bar. The chimney had a volume of 12 cubic inches. Upon ignition, the resulting fuel/air explosion produced a sound level of about 115.9 decibels at a distance of about 75 yards with no visible smoke.

A comparable sound level was obtained using a flash composition including finely divided potassium perchlorate (KP) (14 grams), aluminum metal (Al) (6 grams), and trace iron oxide. The flash composition was inserted inside a steel mortar with a single cavity of 3 cubic inches. In practice, the mortar is preferably positioned to direct the explosion upwards.

It has been unexpectedly found that repeating the above fuel/air concussion test but without the shock bar 20 in place resulted in no concussive explosion. The bottom powder charge burned with little violence, and is attributed to lack of confinement. In this manner, the removal of the shock bar 20 advantageously provides a means to selectively make the likelihood of a concussive detonation at least much less likely, which may not possible with a mixed flash charge.

Although the embodiments of this disclosure have been described with respect to certain exemplary embodiments, it is to be understood that the specific embodiments are for purposes of illustration and not limitation, as other variations will occur to those of skill in the art.

What is claimed is:

1. A concussion device comprising: a structure comprising a cavity, the cavity having a top opening; a first energetic charge disposed in a bottom portion of the cavity; an elongated member having a length, a width, and a thickness, with the length being greater than both the width and the thickness of the elongated member, said elongated member removably secured to the structure within the cavity, the length of the elongated member extending across the cavity to partially cover a horizontal cross-sectional area of the cavity defined on a perimeter by walls of the cavity, the horizontal cross-sectional area covering the first energetic charge, said elongated member removably secured to remain substantially in place during detonation of said first energetic charge.

2. The concussion device of claim 1, further comprising a second energetic charge within the cavity overlying the member.

3. The concussion device of claim 2, wherein the first and second energetic charges comprise about 20 to about 100 weight percent nitrocellulose based on a total weight of the energetic charge composition.

4. The concussion device of claim 3, wherein at least one of the first and second energetic charges comprise less than about 20 weight percent colorants and oxidizers based on a total weight of the respective energetic charge composition.

5. The concussion device of claim 2, wherein the cavity comprises a lower portion having a first volume surrounding the first energetic charge and an upper portion comprising a second volume surrounding the second energetic charge wherein the second volume is larger than the first volume.

6. The concussion device of claim 1, wherein the cavity comprises a smaller width at the bottom portion compared to an upper portion of the cavity.

7. The concussion device of claim 1, wherein the cavity comprises a rectangular, conical, or circular shape or combination thereof.

8. The concussion device of claim 1 wherein the member fully extends across the width of the cavity to partially cover the cross-sectional area.

9. The concussion device of claim 1, wherein the member is removably secured by being disposed in at least one of slots and holes disposed in walls comprising the structure.

10. The concussion device of claim 1, further comprising an ignition source proximate the at least one first energetic charge.

11. The concussion device of claim 10, wherein the ignition source comprises an electric match embedded in the ignition source.

12. The concussion device of claim 10, wherein the ignition source comprises a detonating charge.

13. The concussion device of claim 2, wherein the first and second energetic charges comprise one or more of loose powder, fiber, and pressed pellets of material.

14. The concussion device of claim 13 wherein at least one of the first and second energetic charges are at least partially contained within a thin film of material.

15. The concussion device of claim 1 wherein the elongated member comprises at least one of a rod and bar having at least one of a rectangular and circular shape.

16. The concussion device of claim 1, wherein at least one of the first and second energetic charges comprises one or more of transition and rare earth elements, chlorine, $Sr(NO_3)_2$, $SrCO_3$, Parlon, Aluminum Perchlorate (AP), ammonium nitrates, metal nitrates, perchlorates, phosphates, carbonates, aminotetrazoles, arsenites, oxalates, oxychlorides, peroxides, oxides, sulphates, fluorides, and metal powders.

17. The concussion device of claim 1, wherein the elongated member is disposed to fully extend across a diameter of the cross-sectional area.

18. The concussion device of claim 1, wherein the elongated member is disposed to extend across a central portion of the cross-sectional area.

19. A concussion device comprising: a structure comprising a cavity, the cavity having a top opening; a first energetic charge disposed in a bottom portion of the cavity; an elongated member having a length, a width, and a thickness, with the length being greater than both the width and the thickness of the elongated member, said elongated member removably secured to the structure within the cavity to extend across the cavity to partially cover a horizontal cross-sectional area of the cavity defined on a perimeter by walls of the cavity, the horizontal cross-sectional area covering said first energetic charge.

20. A concussion device comprising: a structure comprising a cavity, the cavity having a top opening; a first energetic charge disposed in a bottom portion of the cavity; an elongated member having a length, a width, and a thickness, with the length being greater than both the width and the thickness of the elongated member, the elongated member removably secured to the structure within the cavity and partially overlying the first energetic charge; wherein the cavity comprises a lower portion having a first volume surrounding the first energetic charge and an upper portion comprising a second volume surrounding the second energetic charge wherein the second volume is larger than the first volume.

* * * * *